United States Patent [19]

Cable et al.

[11] Patent Number: 4,644,029

[45] Date of Patent: Feb. 17, 1987

[54] CHROMATE COATINGS FOR METALS

[75] Inventors: Jane Cable, Slough; George Higgins, Windsor, both of England

[73] Assignee: Pyrene Chemical Services Limited, Buckinghamshire, England

[21] Appl. No.: 773,483

[22] Filed: Sep. 9, 1985

[30] Foreign Application Priority Data

Sep. 25, 1984 [GB] United Kingdom ..... 8424159

[51] Int. Cl.[4] ..... C08K 3/22

[52] U.S. Cl. ..... 524/407; 148/6.2; 252/389.5; 427/435; 427/436

[58] Field of Search ..... 524/407; 252/389.5; 148/6.2; 427/435, 436

[56] References Cited

U.S. PATENT DOCUMENTS

| | | | |
|---|---|---|---|
| 3,053,691 | 9/1962 | Hartman | 524/407 |
| 3,451,865 | 6/1969 | Bretz | 524/407 |
| 4,161,409 | 7/1979 | Schiffman | 524/407 |
| 4,540,733 | 9/1985 | Ito | 524/407 |

*Primary Examiner*—Paul R. Michl

*Attorney, Agent, or Firm*—Arthur E. Kluegel

[57] ABSTRACT

A composition and method are particularly suitable for applying a corrosion preventive and paint receptive coating to metal surfaces where immersing treatment is impossible or impractical. A brush-on aqueous composition free of reducing agent containing hexavalent and trivalent chromium and at least 5 g/l of silica or silicate together with an organic solvent and thickening agent is applied to the metal surface and dried.

11 Claims, No Drawings

CHROMATE COATINGS FOR METALS

BACKGROUND OF THE INVENTION

Numerous processes are known for forming on metal substrates protective coatings that will improve the corrosion resistance of the substrate and/or improve the adhesion of a subsequently applied paint coating. The great majority of these processes are designed for operation under controlled factory conditions. For instance it is well known to form conversion coatings by spraying or dipping with acidic zinc phosphate solutions. Various other phosphating solutions are known as are various chromating solutions.

Many of these processes involve chemical reaction during, for instance, immersion in the treatment solution and as a result satisfactory coating formation occurs almost irrespective of the shape of the surface. However in some processes the coating formation occurs as a result of the treatment solution drying onto the surface, and the shape of the surface can then affect the results, highly convex areas often being inadequately coated. For instance the chromating treatment described in British Patent Specification No. 1,234,181 involves drying the treatment solution onto the surface being coated and although the process has proved very satisfactory for relatively flat surfaces (for instance continuous steel strip) it has not proved very satisfactory for highly curved areas.

Particular problems arise when a protective coating is to be formed on large external structures such as bridge railings and street lights. One difficulty arises from the fact that the treatment solution is likely to drain from highly convex parts of the structure and so an inadequate coating will occur in these areas. Another problem is that the surfaces of the structure are unlikely to have been cleaned to the extent that is conventional in factory processes and it may therefore be difficult to achieve uniform coating of the treatment solution onto the surfaces.

In practice very few systems are available for forming protective coatings on external structures. Frequently no protective coating is applied or, in the case of galvanized iron, the galvanized coating is allowed to age in the atmosphere to form a base for a subsequently applied paint coating. Etch primers based on polyvinyl butyral resin, phosphoric acid and zinc tetroxy chromate necessitate the use of two-pack systems, are inconvenient to apply and are incompatible with some top coats.

As mentioned above, factory application of chromate coatings by the process described in British Patent Specification No. 1,234,181 gives satisfactory coatings on steel strip and other relatively flat surfaces but does not give satisfactory coating formation on highly convex surfaces and on external structures. For instance although it is possible to apply a satisfactory coating on the relatively flat surfaces of a pipeline by the process described in British Patent Specification No. 1,234,181 it is difficult or impossible to achieve a satisfactory coating on the ends of the pipe or on shaped pipe couplings and it is difficult to repair the coating if it is damaged, for instance after the pipe has been fixed in position.

It has been our object to devise a solution for forming satisfactory chromate coatings on surfaces that can be the surfaces of external structures and that can be highly convex or that can be pipe couplings or damaged parts of pipelines otherwise treated by a process as described in British Patent Specification No. 1,234,181.

SUMMARY OF THE INVENTION

A brushable acidic aqueous composition according to the invention has, dissolved or uniformly dispersed therein, hexavalent chromium, trivalent chromium and at least 5 g/l silica and/or silicate, is substantially free of reducing material and includes an organic solvent and organic thickener that render the composition brushable and are stable in the composition.

DETAILED DESCRIPTION OF THE INVENTION

Solvents useful in compositions according to the invention must be stable in the composition, despite the presence of chromic acid, should preferably be non-toxic and should be reasonably volatile in order to reduce the drying time of compositions. The preferred solvent in these compositions has been found to be N-methyl-2-pyrollidone. The amount is generally 25 to 200 g/l, preferably 70 to 150 g/l.

The organic thickener, together with the silica and/or silicate which has some thickening effect, should be capable of making the composition thick enough to be brushable, should be compatible with the solvent, and should be stable in the composition. A suitable thickener is polyvinyl pyrollidone. The amount is generally 10 to 100 g/l, preferably 30 to 75 g/l.

Generally the composition contains a surfactant which improves the application of the composition, especially on metal surfaces which are dirty. The surfactant must be stable in the composition. The surfactant comprises a non-ionic compound, optionally in combination with an anionic compound, optionally in combination with an anionic compound, generally being introduced as the sodium salt. The nonionic compound is suitably a condensate of ethylene oxide monomers and the anionic compound may be sodium lauryl sulphate. The amount of surfactant can be up to 100 g/l with amounts of 5 to 50 g/l generally being preferred.

The adhesion of the coating to the metal surface can be improved by including a monovalent metal compound as described in British Patent Specification No. 1,234,181 or by including a divalent metal compound provided this does not undesirably reduce the hexavalent chromium. Suitable monovalent cations are sodium and potassium. Suitable divalent cations are calcium, magnesium, nickel, barium and strontium, but zinc is often preferred. The amount of monovalent or divalent cation is generally up to 3 g/l, often 0.05 to 2.5 g/l. The ratio of hexavalent chromium calculated as $CrO_3$ to the monovalent or divalent metal (calculated as the hydroxide) is usually from 5:1 to 100:1 by weight.

The compositions may otherwise be as described in British Patent Specification No. 1,234,181. Thus preferably they will have a pH of below 4 and generally above 2, around 2.5 to 3.5 generally being preferred. The amount of silica and/or silicate is preferably from 5 to 100 g/l. It is preferably introduced as fume or precipitated silica, such as the material sold under the Trademark "Aerosil", but any of the other materials mentioned in that patent can be used.

The compositions of the invention are normally prepared by the partial reduction of an aqueous solution of chromic acid, which may contain some or all of the other components of the composition. The chromic acid solution may also be partially neutralized, that is it may be formed in part from a water-soluble chromate or dichromate salt, such as sodium or potassium dichromates. Nevertheless the aqueous solution must be strongly acid and preferably has a pH of less than 2.0, most preferably less than 1.5 before reduction. The solution contains at least 5 g/l $CrO_3$ and normally such solution will contain 100 to 500 g/l.

An appropriate quantity of a reducing agent is then added and is oxidized, if necessary by heating the solution, to effect the partial reduction of chromic acid to the trivalent state so that the solution contains both a hexavalent and a trivalent chromium compound, though the two compounds may be intercombined as chromic chromate.

The ratio of hexavalent chromium to the total chromium present in compositions is generally between 0.5:1 and 0.75:1. The total amount of chromium (calculated as $CrO_3$) in the compositions is usually 5–40, preferably 10–40 g/l and the amount of hexavalent chromium is preferably 5–30 g/l, measured as $CrO_3$.

When a corrosion-resistant coating is to be applied and the treated surface is subsequently painted, it is best for the ratio to approach 0.5:1 as nearly as possible consistent with avoidance of precipitation in order to achieve maximum paint adhesion. In such cases the ratio is usually 0.55–0.63:1.

The reducing agent is normally added in the amount calculated to obtain the desired ratio of hexavalent to total chromium. The reducing agent employed is one that is capable of effecting the reduction of chromium from the hexavalent to the trivalent state and should be one which does not leave deleterious by-products in the solution. For this reason sulphur-containing reducing agents are desirably avoided in order that the corrosion resistance of the coated metal should not be adversely affected. Organic reducing agents are preferred since the by-products are often inoccuous. Particularly preferred are sugars such as dextrose, glucose and sucrose; reducing starches; alcohols such as methanol; ethanol, ethylene glycol, polyethylene glycol, glycerol, mannitol, sorbitol; alkylolamines such as triethanolamine; and hydroquinone. Inorganic reducing agents can also be employed; for example hydroxylamine (preferably not as the sulfate salt) or phosphorous acid may be employed.

Compositions according to the invention are generally applied by brushing on to the metal surface to be coated. The compositions are allowed to dry without subsequent rinsing, drying being by exposure to the air or by heating.

Metals that may be treated by compositions of the invention include aluminum, magnesium, zinc including galvanized iron, alloys of any of these and, preferably steel. The coatings may be applied to large external fixed structures, and are particularly useful in the installation of large external pipelines, on couplings for these and in repairing damaged coatings on these types of articles. The coatings are also found to be useful as a base for adhesives for bonding metal surfaces together, for example using epoxy-based adhesives in for instance the motor industry. Until this invention was made there was no satisfactory way of producing protective coatings on local areas where adhesion was to take place before the whole body was coated. The coatings are also good as a base for epoxy coating of pipelines and are better than conventional coatings over prolonged periods of time. The compositions according to the invention are stable over a fairly long storage period, for instance several months.

The resulting coated articles may have a subsequent top coat of paint or lacquer applied. It is found that compositions according to the invention provide coatings which improve the adhesion of various top coating treatments.

The following example illustrates the invention.

EXAMPLE

A mixture of the following components in the stated amounts (by weight) provides a composition according to the invention:

| | |
|---|---|
| chromium (VI) oxide | 21 |
| wheat starch | 3 |
| zinc carbonate | 1 |
| N—methyl-2-pyrollidone | 100 |
| sodium lauryl sulphate | 20 |
| Aerosil 200 (100% $SiO_2$) | 40 |
| Lubrol G (blended non-ionic surfactant) | 20 |
| polyvinyl pyrollidone | 50 |
| water up to 1,000 | |

The hexavalent chromium was pre-reacted with the starch to yield a ratio of hexavalent to total chromium of 0.6. The resultant composition, having a pH value of approximately 3, could easily be brushed onto a profiled steel structure, such as a pipe coupling and it dried upon exposure to the ambient atmosphere to give a coating that appeared substantially uniform. A conventional paint coating was applied and satisfactory adhesion was observed.

Additionally, mild steel specimens were coated with the composition by brush and allowed to dry. These were then bonded together using a heat curing epoxy adhesive and the unbonded areas carefully protected. These specimens survived 5,000 hours of humidity testing before failing a simulated wedge test. Specimens identically prepared but without the treatment according to this invention survived only 1,200 hours.

Similarly bonded specimens were prepared and were then processed through a full automotive industry pretreatment and paint system and subjected to corrosion testing. The specimens treated with the novel chromate solution exhibited minimal rust bleed-out from the joint, whereas those specimens not treated according to this invention showed considerable rusting from the bond area which caused the entire specimen to look cosmetically unattractive and very corroded.

What is claimed is:

1. A brushable acidic aqueous composition containing dissolved or uniformly dispersed hexavalent chromium, trivalent chromium and at least 5 g/l silica and/or silicate, which is substantially free of reducing material and includes a nonionic surfactant, N-methyl-2-pyrollidone, and organic thickener that render the composition brushable and that are stable in the composition.

2. A composition according to claim 1 in which the N-methyl-2-pyrollidone is present in an amount in the range 25 to 200 g/l.

3. A composition according to claim 1 in which the organic thickener is present in an amount in the range 10 to 100 g/l.

4. A composition according to claim 3 in which the organic thickener is polyvinyl pyrollidone.

5. A composition according to claim 1 in which the silica and/or silicate is present in an amount in the range of 5 to 100 g/l.

6. A composition according to claim 1 in which the ratio or hexavalent chromium to the total chromium present is in the range 0.5:1 to 0.75:1.

7. A composition according to claim 1 in which the total amount of chromium (calculated as $CrO_3$) in the composition is in the range 5 to 40 g/l.

8. A composition according to claim 1 in which additionally contains mono- or di-valent metal ions selected from sodium, potassium, calcium, magnesium, nickel, barium, strontium and zinc ions, in an amount such that the ratio of hexavalent chromium (calculated as $CrO_3$) to the mono- or divalent metal (calculated as the hydroxide) is in the range from 5:1 to 100:1 by weight.

9. A composition according to claim 1 having a pH of less than 4.

10. A method of treating a metal surface by brushing a composition according to claim 1 on to the surface and allowing the composition to dry.

11. A metal surface, selected from aluminum, magnesium, zinc, iron and any of their alloys, galvanized iron and steel surfaces, having therein a coating formed by the method of claim 10.

* * * * *